US008040231B2

(12) United States Patent
Kuruvila et al.

(10) Patent No.: US 8,040,231 B2
(45) Date of Patent: Oct. 18, 2011

(54) METHOD FOR PROCESSING ALARM DATA TO GENERATE SECURITY REPORTS

(75) Inventors: Anoop Kuruvila, Karnataka (IN); Sridhar Ganta, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 461 days.

(21) Appl. No.: 12/245,371

(22) Filed: Oct. 3, 2008

(65) Prior Publication Data

US 2010/0085182 A1 Apr. 8, 2010

(51) Int. Cl.
*G08B 29/00* (2006.01)

(52) U.S. Cl. ..... 340/506; 340/539.1; 340/541; 340/568.1; 340/571

(58) Field of Classification Search ..... 340/506, 340/539.1, 540, 541, 568.1, 571, 521, 531
See application file for complete search history.

(56) References Cited

U.S. PATENT DOCUMENTS

| | | | | |
|---|---|---|---|---|
| 5,428,555 | A * | 6/1995 | Starkey et al. | 700/275 |
| 5,440,688 | A | 8/1995 | Nishida | |
| 6,263,455 | B1 | 7/2001 | Bannister | |
| 6,930,599 | B2 * | 8/2005 | Naidoo et al. | 340/539.1 |
| 7,158,026 | B2 * | 1/2007 | Feldkamp et al. | 340/531 |
| 7,304,574 | B2 | 12/2007 | Romer et al. | |
| 2006/0156967 | A1 | 7/2006 | You et al. | |

* cited by examiner

*Primary Examiner* — Hung T. Nguyen
(74) *Attorney, Agent, or Firm* — Husch Blackwell

(57) ABSTRACT

A system and method are provided that allow analysis of alarm data to generate security reports. A security report system may include a monitoring tool and a data analyzer. The monitoring tool may include an alarm data acquiring module and an alarm database for storing the alarm data acquired by the alarm data acquiring module. The data analyzer may include a data parsing module for parsing the alarm data into a plurality of data segments each indicating an attribute of the alarm data, a data categorizing module for categorizing the plurality of data segments into a plurality of data groups in accordance with the attributes of the data segments, and a data processing module for processing the data segments of at least one of the data groups to generate a security report.

20 Claims, 5 Drawing Sheets

METHOD FOR PROCESSING ALARM DATA TO GENERATE SECURITY REPORTS

FIELD OF THE INVENTION

The present invention relates generally to data analysis and data processing. More particularly, the present invention relates to a method and system for processing alarm data generated in a security system, especially alarm data generated by a central monitoring station of the security system, to generate security reports in connection with an area monitored by the security system.

BACKGROUND OF THE INVENTION

Security systems offer a degree of security for residential sites and for office, business, and/or industrial applications. Typically, a security device, such as a sensor or a camera, monitoring a protected area is provided as part of a security system. Such security system devices can detect the occurrence of various alerting events, such as a breach of the protected area, a fire condition, or other types of condition, and can generate alarm signals, notification and/or data indicative of the events. The signals or data are usually transmitted through wired or wireless connections to a security control panel configured for processing the alarm signals or data from the security device and for implementing other functionalities based on the processed results of the alarm signals or data, such as arming the system, disarming the system, providing system status and generating alerting messages indicative of the events, coordinating the operations of different functional modules of the system, and so on.

In addition, a central monitoring station is normally provided to communicate with the security control panel for receiving, routing and sending the messages generated by the control panel to the terminal devices of the users of the security system, notifying them of the occurrence of alerting events. The central monitoring station usually receives data from the security control panel and further processes the received data to generate alarm data. The alarm data can be in any suitable format.

FIG. 1 is a block diagram illustrating a known security system 10, which communicates with a user's terminal device 40 via an IP network 60. The security system 10 is generally configured to detect the occurrence of a predefined alert event and notify the user of the occurrence of the event through a message, such as an email or SMS.

The security system 10 includes at least one security device 20 configured to detect an event, such as a breach of protected premises, and transmit signals in response to the event. The system 10 further includes a security control panel 30 in communication with the security device 20 through the IP network 60, for processing the signals from the security device and controlling the operations of other functional modules of the system. A central monitoring station 50 is in communication with the security control panel 30 through the IP network 60. The central station 50 is capable of processing the received data to generate alarm data.

However, no extended applications of the alarm data generated by the central monitoring station have been envisioned and developed so far. Thus, it is desirable to provide extended application of the alarm data generated by the central monitoring station, for example, to produce extra revenues.

BRIEF SUMMARY OF THE INVENTION

According to the present invention, method and system for analyzing alarm data generated by a central monitoring station of a security system to generate security reports are provided.

The method includes acquiring alarm data from the central monitoring station, storing the alarm data in an alarm database, parsing the alarm data into a plurality of data segments each having an attribute associated with the alarm data, categorizing the plurality of data segments into a plurality of data groups in accordance with the attribute of each data segment, processing the data segments of at least one of the data groups to generate a security report. One aspect of the method may comprise statistically processing the data segments of at least one of the data groups to generate a security report.

The security report system comprises a monitoring tool and an alarm data analyzer. The monitoring tool comprises an alarm data acquiring module for acquiring alarm data, and an alarm database for storing the alarm data. The data analyzer comprises a data parsing module for parsing the alarm data into a plurality of data segments each having an attribute associated with the alarm data, a data categorizing module for categorizing the plurality of data segments into a plurality of data groups in accordance with the attributes of the data segments, and a data processing module for processing the data segments of at least one of the data groups to generate a security report. One aspect of the system comprises an interface for transferring the alarm data from the alarm database to the data parsing module. Another aspect of the system comprises a group database for storing the plurality of data groups. Another aspect of the system comprises a processing element for applying a statistical model to the data segments of at least one of the data groups to generate a security report.

A program storage device readable by a machine, tangibly embodying a program of instructions executable by the machine to perform the above-described method steps may be also provided.

BRIEF DESCRIPTION OF THE DRAWINGS

Further features as well as the structure and operation of various embodiments are described in detail below with reference to the accompanying drawings. In the drawings, like reference numbers indicate identical or functionally similar elements.

DETAILED DESCRIPTION

The present invention now will be described in detail hereinafter with reference to the accompanying drawings, in which exemplary embodiments of the invention are shown. However, this invention may be embodied in many different forms and should not be construed as limited to the embodiments set forth herein. Like numerals refer to like elements throughout.

As used herein, "configured to" and the like refer to mechanical or structural connections between elements to allow the elements to cooperate to provide a described effect;

these terms also refer to operation capabilities of electrical elements such as analog or digital computers or application specific devices that are programmed to perform steps to provide an output in response to given input signals.

Figure 1:
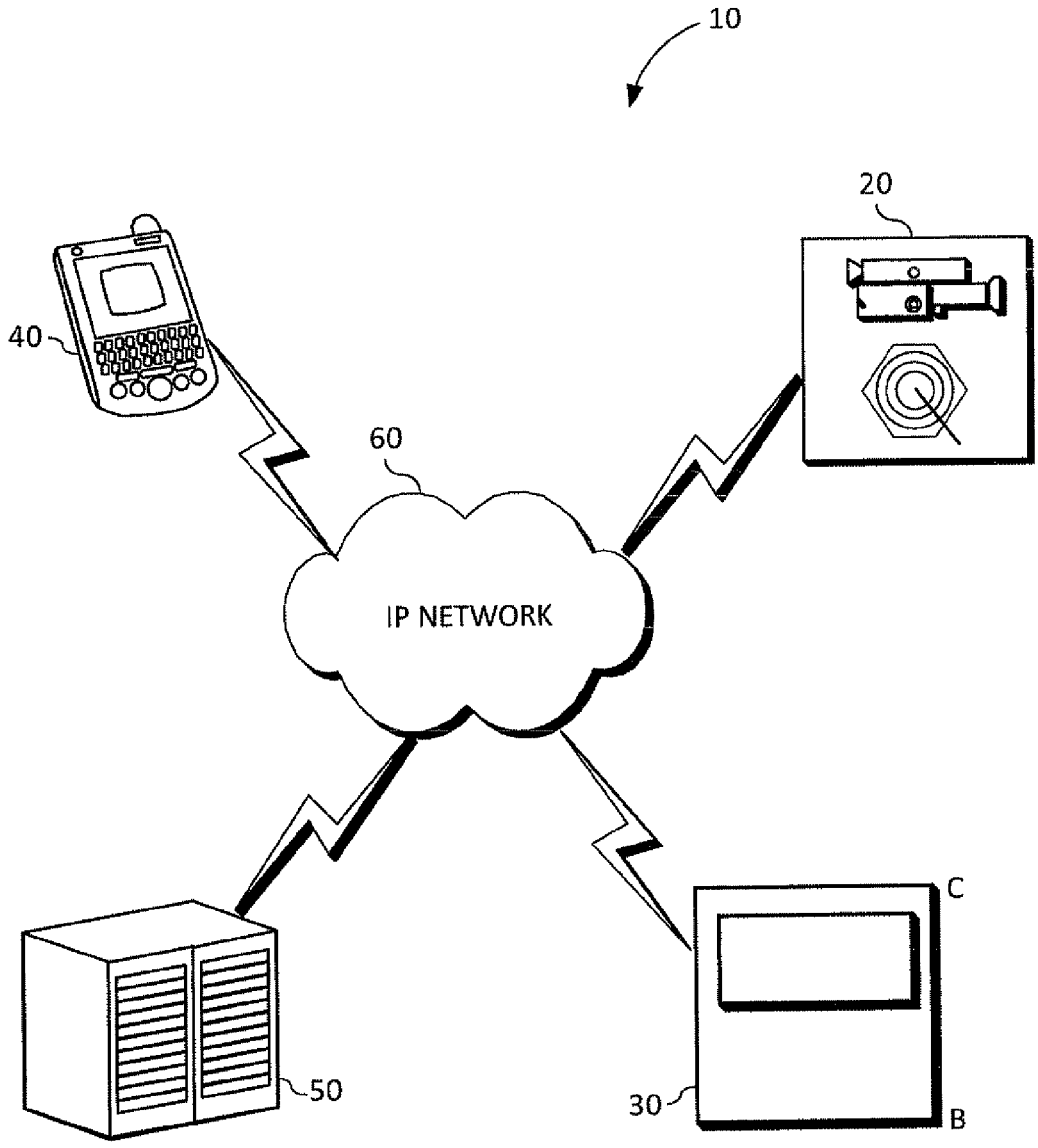
FIG. 1 is a block diagram illustrating the architectural overview of a known security system.
Figure 2:
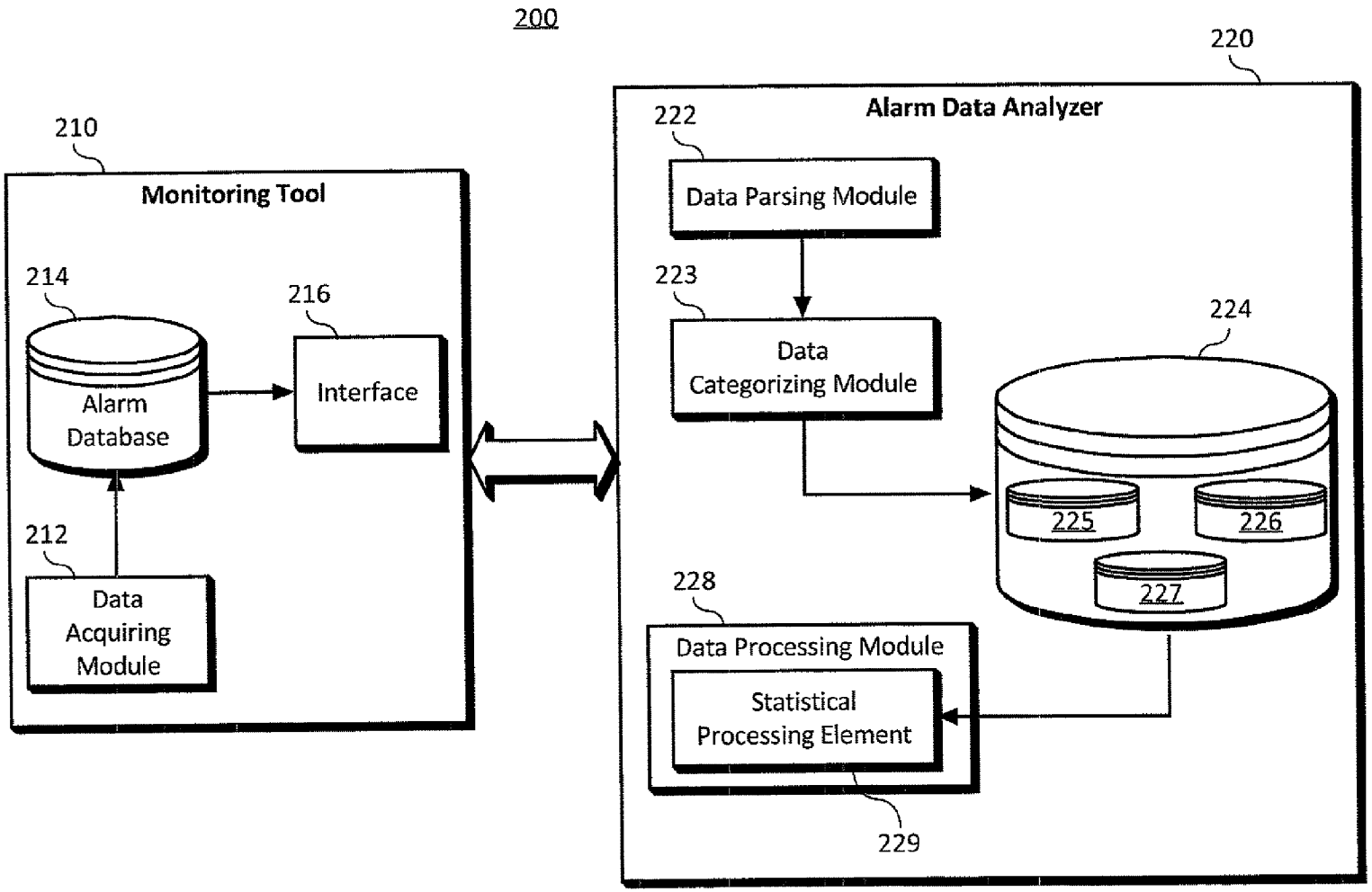
FIG. 2 is a block diagram illustrating a security report system according to an exemplary embodiment of the present invention.

A system and method are provided to allow extended applications of alarm data acquired by a central monitoring station in a security system, such as the central monitoring station 50 shown in FIG. 1. FIG. 2 is a schematic block diagram illustrating a security report system 200 according to an exemplary embodiment of the present invention. For example, the security report system 200 can be embodied as hardware, software or the combination of hardware and software. The security report system 200 can be integrated with the central monitoring station 50 or with a separate PC in communication with the central monitoring station 50.

In the shown embodiment, the security report system 200 includes a monitoring tool 210 and an alarm data analyzer 220 in communication with the monitoring tool 210. The monitoring tool 210 serves to acquire alarm data from the central monitoring station 50 and transfer the acquired alarm data to the alarm data analyzer 220 for generating a security report. The monitoring tool 210 includes an alarm data acquiring module 212 in communication with the central monitoring station 50 through known wired or wireless connection. The alarm data acquiring module 212 may process the acquired data, such as determining and filing data associated with false alarms, before the acquired data is stored in an alarm database 214. The monitoring tool 210 further includes an interface 216, such as an Application Programming Interface (API), for exchanging messages or data between the monitoring tool 210 and the alarm data analyzer 220. In operation, the interface 216 retrieves alarm data from the alarm database 214 and transfers the retrieved data to a data parsing module 222 of the alarm data analyzer 220.

The data parsing module 222 functions to parse the alarm data transferred from the interface 216 into a plurality of data segments, with each data segment having an attribute associated with the alarm data.

Figure 5:
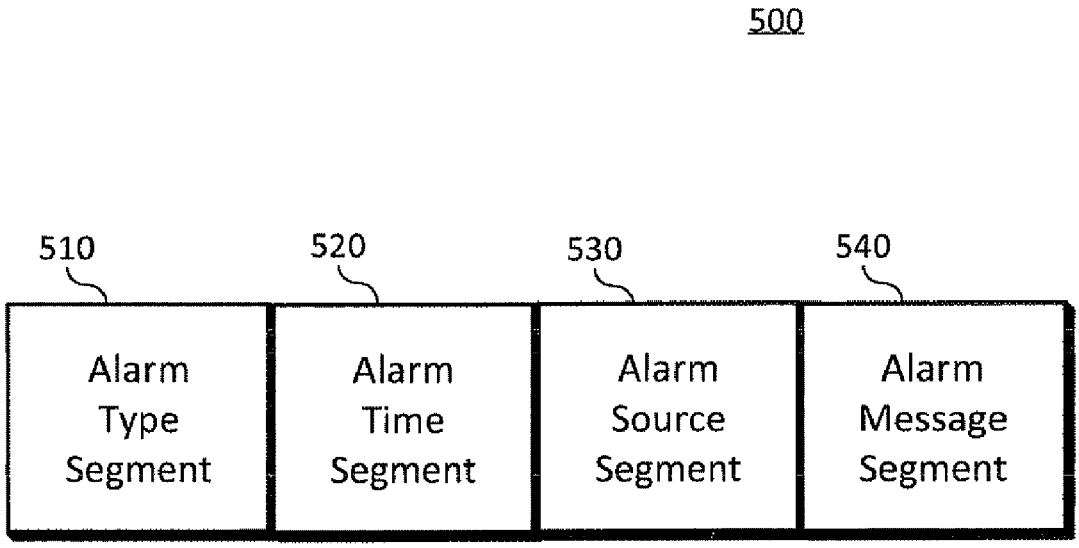
FIG. 5 illustrates the structure of an alarm data used in connection with an exemplary embodiment of the present invention.

FIG. 5 illustrates an exemplary structure of an alarm data 500 comprising various segments, each associated with an attribute of the alarm data. For example, the data parsing module 222 parses the alarm data 500 into an alarm type segment 510 associated with the type related attribute of the alarm data 500, an alarm time segment 520 associated with the time related attribute of the alarm data 500, an alarm source segment 530 associated with the source related attribute of the alarm data 500, and, optionally, an alarm message segment 540 associated with the text related attribute of the alarm data 500.

For example, the alarm type segment 510 associated with the type related attribute comprises, but is not limited to, data indicating a fire alarm and data indicating a burglary alarm. The alarm time segment 520 associated with the time related attribute comprises, but is not limited to, data indicating the time of issuing an alarm, data indicating the date of issuing an alarm, and data indicating the season of the issuing an alarm. The alarm source segment 530 associated with the source related attribute comprises, but is not limited to, data indicating source information of an alarm at a town level, data indicating source information of an alarm at a city level, and data indicating source information of an alarm at a state level. The alarm message segment 540 associated with the text attribute of the alarm data may comprise text descriptions of the occurrence of the alarm. However, it should be understood that the data segments of alarm data and the attributes associated with the data segments are not limited to the above discussed.

The alarm data analyzer 220 further includes a data categorizing module 223 for categorizing the various data segments of the collected alarm data into a plurality of groups according to the attributes associated with the data segments. For example, all the data segments associated with the type related attribute, i.e., all the alarm type segments 510, are categorized by the data categorizing module 223 into a data group, namely an alarm type group 225 saved in a group database 224 of the alarm data analyzer 220. Similarly, an alarm time group 226 and an alarm source group 227 are also generated by the data categorizing module 223 and subsequently saved in the group database 224.

The alarm data analyzer 220 further includes a data processing module 228 for generating a security report. The data processing module 228 retrieves at least one data group from the alarm type group 225, alarm time group 226 and alarm source group 227 saved in the group database 224, and processes the data segments in the selected group to generate a security report. For example, the data processing module 228 has a statistical processing element 229 for applying a statistical model to the retrieved data segments of the selected group, to generate a security report.

For example, the processing element 229 applies a predefined statistical model to the alarm time segments 520 including data indicating the time of issuing an alarm, the date of issuing an alarm, and the season of the issuing an alarm, thereby generating a time wise security report analyzing the trends or patterns of the occurrence of alarm triggering events in a day, a week or a season. In addition, the processing element 229 may further apply a predefined statistical model to the alarm type segments 510 to generate a security report with the patterns of the type of the occurrence of alarm triggering events on the basis of or in connection to the above time wise analysis, thereby generating a more comprehensive security report. The alarm source segments 530 can be processed statistically by the processing element 229 to generate a security report indicating, for example, the frequency of occurrence of alarm triggering events at a certain location. However, it should be understood that the various data segments can be processed in various combinations and manners, to accomplish security reports comprehensive at various levels.

The security reports generated by the security report system according to an exemplary embodiment of the present invention can be further analyzed or processed by a third party to generate extra revenue. For example, the security reports can be sold to an insurance company for estimating insurance premiums for specific areas or for specific time spans. The security report can also be sold to media for broadcasting preventive messages to the public.

Figure 3:
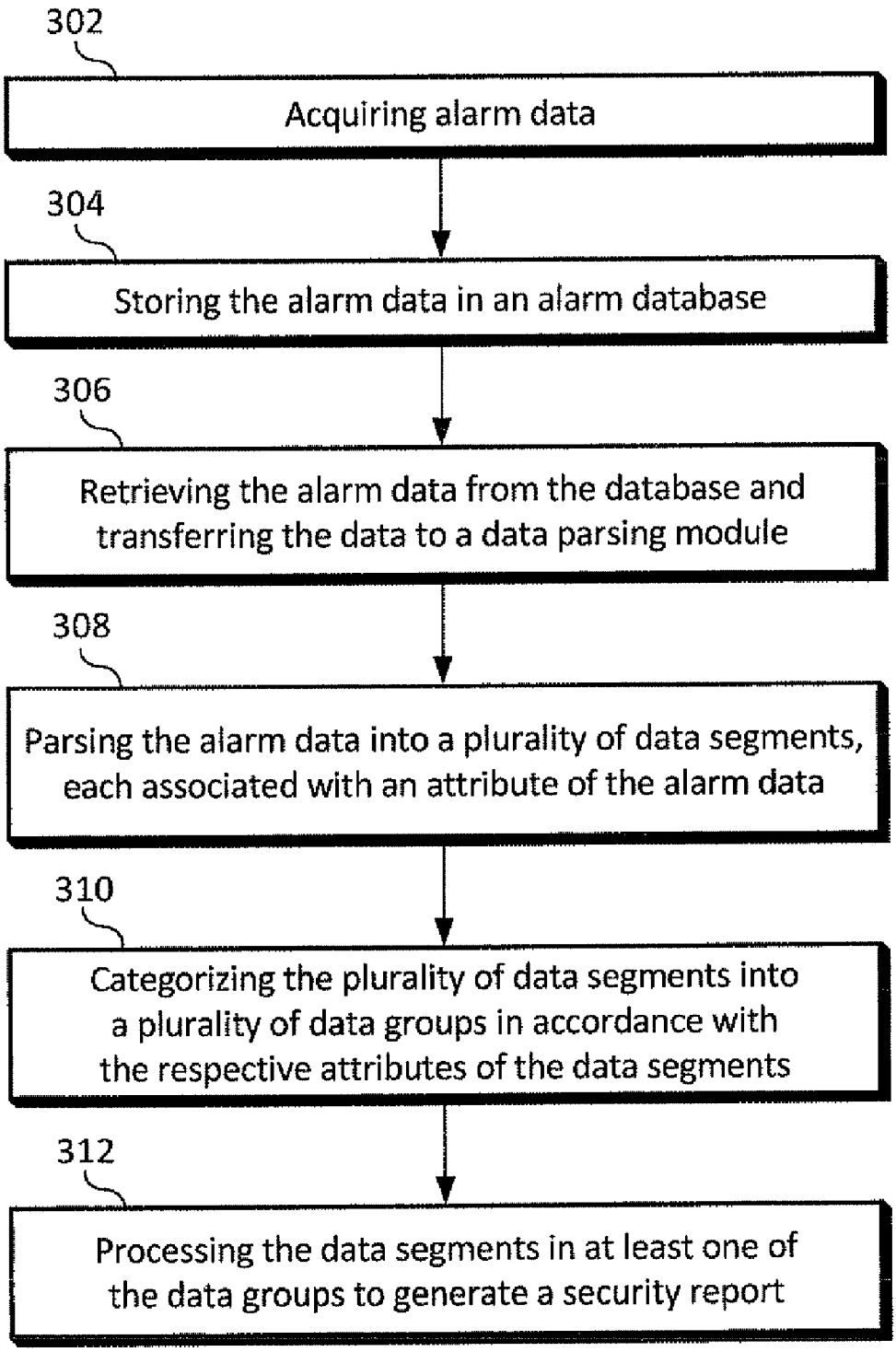
FIG. 3 is a flow chart illustrating the steps of a method for processing alarm data to generate security reports according to an exemplary embodiment of the present invention.

FIG. 3 is a flow chart illustrating steps of a method 300 for processing alarm data to generate security reports according to an exemplary embodiment of the present invention.

The alarm data generated by a central monitoring station is acquired at step 302, and further saved in an alarm database at step 304. At step 306, the alarm data is retrieved and further transferred to a data parsing module. At step 308, the alarm data are parsed into a plurality of data segments, each associated with an attribute of the alarm data. At step 310, the plurality of data segments are categorized into a plurality of data groups in accordance with the respective data attributes associated with the data segments. At step 312, the data segments from at least one of the data groups are processed to generate a security report. Specifically, at step 312, the data segments are statistically processed to generate a security report.

Figure 4:
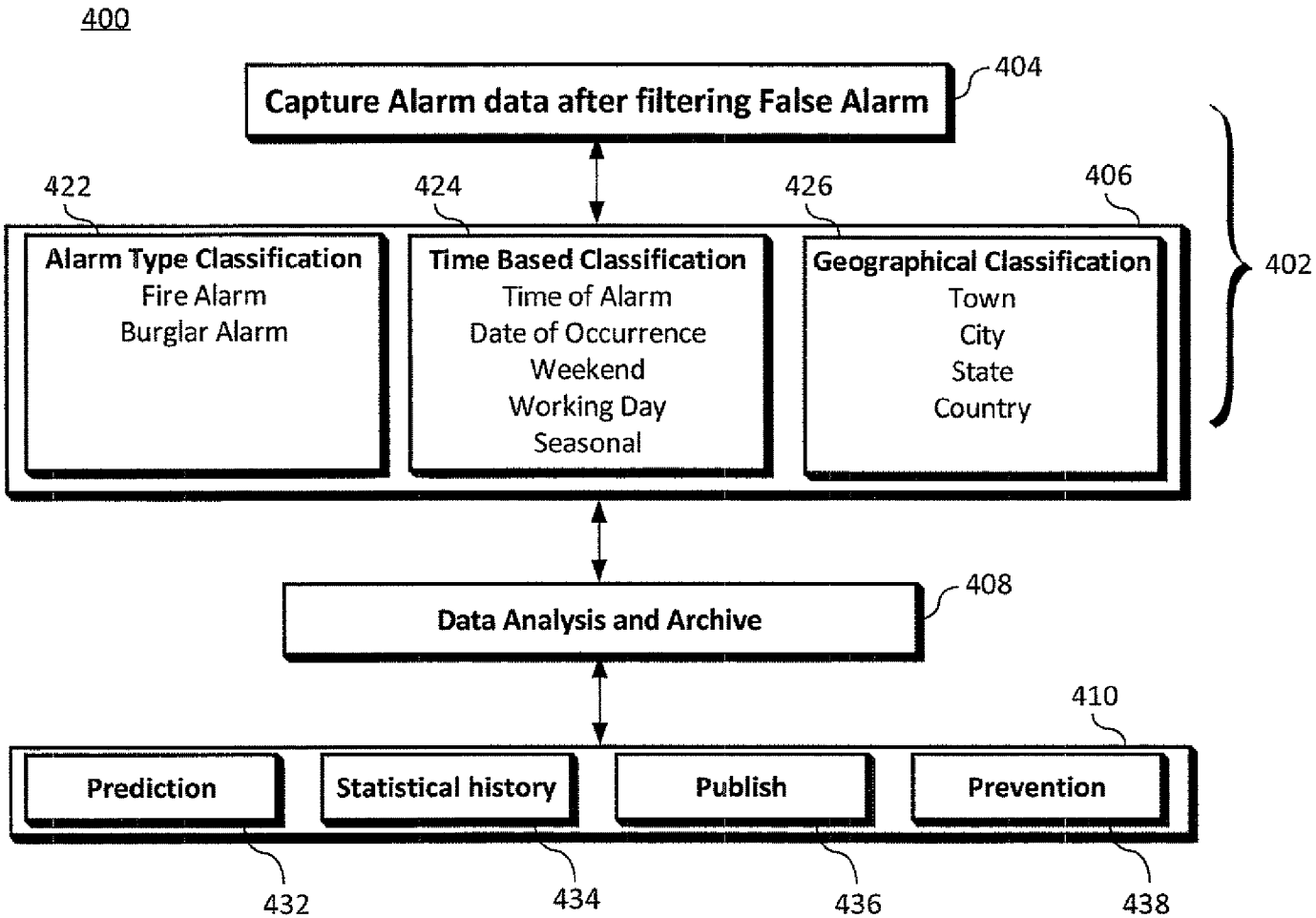
FIG. 4 is an architectural diagram of a software system embodying the method for processing alarm data according to an exemplary embodiment of the present invention.

FIG. 4 is an architectural diagram of a software system 400 embodying the method for processing alarm data according to an exemplary embodiment of the present invention.

The software system 400 comprises a data tier 402 having a data capturing subtier 404 and a data classification subtier 406, a logic tier 408, and a presentation tier 410. At the data tier 402, alarm data is captured after filtering any false alarm information at the data capturing subtier 404, and subsequently retrieved and categorized at the data classification subtier 406. At the data classification subtier 406, at least three entries are implemented for storing the grouped information, namely alarm type classification 422, time based classification 424 and geographical classification 426. Within the alarm type classification entry 422, the alarm type information is stored, for example, as either fire alarm or burglary alarm. Within the time based classification entry 424, information concerning the time of occurrence of an alarm, the date of occurrence of an alarm, and the season of occurrence of an alarm is stored. Within the geographical classification entry 426, information concerning the town, city, state and/or country where an alarm is issued is stored.

At the logic tier 408, the various process commands and logical decisions are made to perform evaluation and calculation, thereby analyzing the alarm data to generate security reports and further archive the reports for subsequent application. At the presentation tier 410, the security reports are further processed to produce results that are understandable and practical to a user. For example, the security reports can be analyzed to produce a prediction entry 432 storing information for predicting the possibility of occurrence of alarm triggering events in certain areas or during certain times, a statistical history entry 434 storing information relative to occurrence of alarm triggering events in the past, a publication entry 436 storing information to be published by a medium, such as a local TV station and/or newspaper, and a prevention entry 438 storing information giving warnings to the public on the occurrence of alarm triggering events in certain areas or during certain time.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

Various aspects of the present disclosure may be embodied as a program, software, or computer instructions embodied in a computer or machine usable or readable medium, which causes the computer or machine to perform the steps of the method when executed on the computer, processor, and/or machine.

The system and method of the present disclosure may be implemented and run on a general-purpose computer or computer system. The computer system may be any type of known or will be known systems and may typically include a processor, memory device, a storage device, input/output devices, internal buses, and/or a communications interface for communicating with other computer systems in conjunction with communication hardware and software, etc.

We claim:

1. A method for processing alarm data generated by a central monitoring station of a security system, comprising steps of:

acquiring alarm data from the central monitoring station;

storing the alarm data in an alarm database;

parsing the alarm data into a plurality of data segments, each having an attribute associated with the alarm data;

categorizing the plurality of data segments into a plurality of data groups in accordance with the attribute of each data segment; and a data processing module processing the data segments of at least one of the data groups to generate a security report.

2. The method of claim 1, wherein the step of processing the data segments comprises statistically processing the data segments.

3. The method of claim 2, wherein the attribute of the alarm data comprises at least one of a type related attribute, a time related attribute, and a source related attribute.

4. The method of claim 3, wherein each of the data segments associated with the type related attribute comprises at least one of data indicating a fire alarm and data indicating a burglary alarm.

5. The method of claim 3, wherein each of the data segments associated with the time related attribute comprises at least one of data indicating the time of issuing an alarm, data indicating the date of issuing an alarm, and data indicating the season of the issuing an alarm.

6. The method of claim 3, wherein each of the data segments associated with the source related attribute comprises at least one of data indicating source information of an alarm at a town level, data indicating source information of an alarm at a city level, and data indicating source information of an alarm at a state level.

7. A security report system, comprising:

a monitoring tool, comprising:

an alarm data acquiring module for acquiring alarm data; and an alarm database for storing the alarm data; and an alarm data analyzer, comprising:

a data parsing module for parsing the alarm data into a plurality of data segments, each having an attribute associated with the alarm data;

a data categorizing module for categorizing the plurality of data segments into a plurality of data groups in accordance with the attributes of the data segments; and a data processing module for processing the data segments of at least one of the data groups to generate a security report.

8. The security report system of claim 7, wherein the monitoring tool further comprises an interface for transferring the alarm data from the alarm database to the data parsing module.

9. The security report system of claim 7, wherein the alarm data analyzer further comprises a group database for storing the plurality of data groups.

10. The security report system of claim 7, wherein the data processing module comprises a processing element for applying a statistical model to the data segments of at least one of the data groups to generate the security report.

11. The security report system of claim 10, wherein the attribute of the alarm data comprises at least one of a type related attribute, a time related attribute, and a source related attribute.

12. The security report system of claim 11, wherein each of the data segments associated with the type related attribute comprises at least one of data indicating a fire alarm and data indicating a burglary alarm.

13. The security report system of claim 11, wherein each of the data segments associated with the time related attribute comprises at least one of data indicating the time of issuing an alarm, data indicating the date of issuing an alarm, and data indicating the season of the issuing an alarm.

14. The security report system of claim 11, wherein each of the data segments associated with the source related attribute comprises at least one of data indicating source information of an alarm at a town level, data indicating source information of an alarm at a city level, and data indicating source information of an alarm at a state level.

15. A program storage device readable by a machine, tangibly embodying a program of instructions executable by the machine to perform a method for processing alarm data, said method comprising the steps of:

acquiring alarm data from the central monitoring station;

storing the alarm data in an alarm database;

parsing the alarm data into a plurality of data segments, each having an attribute associated with the alarm data;

categorizing the plurality of data segments into a plurality of data groups in accordance with the attribute of each data segment; and a data processing module processing the data segments of at least one of the data groups to generate a security report.

16. The program storage device of claim 15, wherein the step of processing the data segments comprises statistically processing the data segments.

17. The program storage device of claim 15, wherein the attribute of the alarm data comprises at least one of a type related attribute, a time related attribute, and a source related attribute.

18. The program storage device of claim 15, wherein each of the data segments associated with the type related attribute comprises at least one of data indicating a fire alarm and data indicating a burglary alarm.

19. The program storage device of claim 15, wherein each of the data segments associated with the time related attribute comprises at least one of data indicating the time of issuing an alarm, data indicating the date of issuing an alarm, and data indicating the season of the issuing an alarm.

20. The program storage device of claim 15, wherein each of the data segments associated with the source related attribute comprises at least one of data indicating source information of an alarm at a town level, data indicating source information of an alarm at a city level, and data indicating source information of an alarm at a state level.

* * * * *